US007042329B2

(12) United States Patent
Nishikori

(10) Patent No.: US 7,042,329 B2
(45) Date of Patent: May 9, 2006

(54) ROTATABLE VARIABLE RESISTOR WITH CLICKING MECHANISM

(75) Inventor: Tatsuya Nishikori, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 0 days.

(21) Appl. No.: 10/846,537

(22) Filed: May 17, 2004

(65) Prior Publication Data

US 2004/0252008 A1 Dec. 16, 2004

(30) Foreign Application Priority Data

Jun. 16, 2003 (JP) ..... 2003-171015
Sep. 29, 2003 (JP) ..... 2003-337796

(51) Int. Cl.
*H01C 10/32* (2006.01)

(52) U.S. Cl. ..... 338/162; 338/170

(58) Field of Classification Search ..... 338/162, 338/163, 171, 167–170, 174, 160, 190
See application file for complete search history.

(56) References Cited

U.S. PATENT DOCUMENTS 3,544,946 A * 12/1970 Murakami ..... 338/174
4,306,216 A * 12/1981 Azema et al. ..... 338/160
4,427,966 A * 1/1984 Gratzinger et al. ..... 338/162
5,291,177 A * 3/1994 Chiu ..... 338/166
5,939,973 A * 8/1999 Imamura ..... 338/172
6,791,049 B1 * 9/2004 Yamazaki ..... 200/564

FOREIGN PATENT DOCUMENTS

JP 62-189704 8/1987
JP 09-063812 3/1997
JP 09-232110 9/1997

OTHER PUBLICATIONS

European Examination Report issued on Oct. 20, 2005 in the corresponding European Application No. 04 012 253.3-2214.

* cited by examiner

*Primary Examiner*—Tu Hoang
(74) *Attorney, Agent, or Firm*—Keating & Bennett, LLP

(57) ABSTRACT

A rotatable variable resistor with a clicking mechanism includes a rotary unit provided with a rotor and a wiper, and a fixed unit provided with a cover, a resistor substrate, and external terminals. The wiper has an arm segment, a clicking projection and a non-clicking projection. The undersurface of the cover is provided with a clicking depression. The distance from the center of rotation of the rotary unit to the top of the clicking projection is different from the distance from the center of rotation to the top of the non-clicking projection. The non-clicking projection may have a flat top portion with a width extending in one direction that is greater than that of the clicking depression such that a sliding track of the top of the clicking projection is located within a sliding track of the non-clicking projection in the radius direction. The clicking depression may alternatively be an aperture.

27 Claims, 11 Drawing Sheets

ROTATABLE VARIABLE RESISTOR WITH CLICKING MECHANISM

BACKGROUND OF THE INVENTION

1. Field of the Invention

The present invention relates to rotatable variable resistors provided with clicking mechanisms, and particularly, to a rotatable variable resistor provided with a clicking mechanism used in, for example, in-vehicle meters for controlling light intensity.

2. Description of the Related Art

In known rotatable variable resistors, a wiper fixed to a rotor slides on a resistor substrate in a circular-arc manner so that the resistance value is varied with respect to the rotational angle of the rotor. Japanese Unexamined Patent Application Publication No. S62-189704 discloses a rotatable variable resistor which includes a wiper and a contact substrate. The wiper is provided with a clicking projection, and the contact substrate is provided with a clicking depression. The clicking projection and the clicking depression are disposed in positions having the same radius, along which the clicking projection slides. With the rotation of the wiper, the clicking projection slides on the contact substrate and engages with the clicking depression, thus imparting a feel of a "click" to an operator.

FIGS. 13 and 14 illustrate an example of a known rotatable variable resistor 100 provided with a clicking mechanism, which includes a wiper 128 provided with a semispherical clicking-projection 129*a* and a semi-oval-shaped non-clicking-projection 129*b*.

The variable resistor 100 further includes a rotor 118 which is integrated with and fixed to the wiper 128. The rotor 118 is rotatably supported by an insulative casing 102 and a collector 133 such that the rotor 118 can rotate within a predetermined angle. A resistor layer 142 is provided on a resistor substrate 141 which is fixed to the casing 102. The wiper 128 has contact portions 130 and 131 which are resiliently urged against the resistor layer 142. By rotating the rotor 118, the contact portions 130 and 131 slide on the resistor layer 142.

The resistor layer 142 is electrically connected to two external terminals 111 and 112 which are fixed to the casing 102. The collector 133 is provided with a clicking depression 134 and an external terminal 135. Moreover, the collector 133 is resiliently urged against the wiper 128 and is electrically connected with the wiper 128.

As described above, the wiper 128 is provided with the clicking projection 129*a* and the non-clicking projection 129*b*, and the collector 133 is provided with the clicking depression 134. The two projections 129*a* and 129*b* are resiliently urged against the collector 133 in a slidable manner. The clicking projection 129*a* slides on the collector 133 and engages with the clicking depression 134 to impart a feel of a "click" to an operator. On the other hand, the top portion of the non-clicking projection 129*b* is made slightly oblong in the sliding direction so as to prevent the projection 129*b* from engaging with the clicking depression 134.

The reasons for providing the non-clicking projection 129*b* are as follows:

1. By providing the non-clicking projection 129*b* in a substantially symmetrical position with respect to the clicking projection 129*a* and constructing the projection 129*b* to have the same height as the projection 129*a*, the balance of the wiper 128 and the rotor 118 are maintained, thereby preventing the wiper 128 and the rotor 118 from tilting.

2. Although the enter/exit action of the clicking projection 129*a* with the clicking depression 134 can cause unsteady contact between the wiper 128 and the collector 133, the non-clicking projection 129*b* stabilizes the contact between the two.

In this conventional variable resistor 100, however, since the top portions of the clicking projection 129*a* and non-clicking projection 129*b* have the same rotational radius, the following problems exist.

Since tilting of the rotor 118 cannot be prevented due to the reaction force of the wiper 128, the top portion of the non-clicking projection 129*b* in that case may engage with the depression 134 to impart an undesired feel of a "click", thus deteriorating the operational feel of the variable resistor 100.

Furthermore, when the two projections 129*a* and 129*b* slide on the collector 133, abrasion dust is released and deposited in the ends of their sliding tracks. The projections 129*a* and 129*b* slide over each other's abrasion dust and generate a noise, which may cause disturbance of the output.

Furthermore, the use of the casing 102 in the variable resistor 100 increases the number of components and thus, complicates the assembly process.

SUMMARY OF THE INVENTION

In order to overcome the problems described above, preferred embodiments of the present invention provide a rotatable variable resistor provided with a clicking mechanism, in which noise is eliminated or reduced without deteriorating the operational feel.

In addition, preferred embodiments of the present invention provide a rotatable variable resistor provided with a clicking mechanism, which has a reduced number of components to allow an easy assembly process.

According to a first preferred embodiment of the present invention, a rotatable variable resistor provided with a clicking mechanism includes a rotary unit and a fixed unit. The rotary unit includes a rotor and a wiper, and the fixed unit includes a resistor substrate and an external terminal. One of the rotary unit or the fixed unit includes a clicking projection and a non-clicking projection. The other one of the rotary unit or the fixed unit is provided with a clicking engagement portion which is engageable with the clicking projection. The distance from the center of rotation of the rotary unit to the top of the clicking projection is different from the distance from the center of rotation of the rotary unit to the top of the non-clicking projection.

Since the clicking projection and the non-clicking projection slide with respect to different radii, the non-clicking projection does not engage with the clicking engagement portion, thus eliminating undesired clicking of the non-clicking projection. This prevents deterioration of the operational feel. Moreover, since the clicking projection and the non-clicking projection do not slide over each other's abrasion dust deposited in the ends of their sliding tracks, the disturbance of output caused by noise is eliminated.

Furthermore, the non-clicking projection may have a top portion extending linearly in the rotational direction of the rotary unit. Since the top portion of the non-clicking projection is made longer in the sliding direction, the abrasion resistance of the top portion is improved so as to contribute to a longer life cycle.

According to a second preferred of the present invention, a rotatable variable resistor with a clicking mechanism includes a rotary unit provided with a rotor and a wiper, and a fixed unit provided with a resistor substrate and an external terminal. Moreover, one of the rotary unit or the fixed unit is provided with a clicking projection and a non-clicking projection, and the other one of the rotary unit or the fixed unit is provided with a clicking engagement portion which is engageable with the clicking projection. According to the second preferred embodiment of the present invention, the non-clicking projection has a flat top portion having a width extending in one direction that is greater than that of the clicking engagement portion. The surface of the flat top portion contacts the other one of the fixed unit or the rotary unit. Furthermore, a sliding track of the top of the clicking projection is located within a sliding track of the non-clicking projection in the radius direction.

Accordingly, since the width in one direction of the flat top portion is greater than that of the clicking engagement portion and the surface of the top portion contacts the fixed unit or the rotary unit, the non-clicking projection does not engage with the clicking engagement portion. This eliminates undesired clicking of the non-clicking projection. Consequently, deterioration of the operational feel is prevented, and moreover, abrasion resistance of the non-clicking projection is improved. Although the sliding tracks of the clicking projection and the non-clicking projection overlap with each other, the non-clicking projection releases a much smaller amount of abrasion dust, which is deposited in the ends of its sliding track, thus reducing the disturbance of output caused by noise.

Furthermore, the fixed unit according to the first and second preferred embodiments of the present invention may further include a conductive cover integrated with an external terminal. Moreover, the clicking engagement portion may preferably be provided in the cover. Thus, the cover may function both as a casing and a collector (namely, one of external terminals), thereby reducing the number of components to allow an easier assembly process.

Furthermore, the clicking engagement portion may either be an aperture or a depression. By providing an aperture for the clicking engagement portion, a better feel of a "click" is imparted as the clicking projection engages with the aperture. Moreover, a good "click" is achieved even with a low contact pressure, thus leading to size reduction of the wiper. Accordingly, this contributes to a size reduction of the entire variable resistor.

According to the first preferred embodiment of the present invention, since the non-clicking projection does not engage with the clicking engagement portion and undesired clicking of the non-clicking projection is thus eliminated, deterioration of the operational feel is prevented. Moreover, since the clicking projection and the non-clicking projection do not slide over each other's abrasion dust deposited in the ends of their sliding tracks, the disturbance of output caused by noise is eliminated.

According to the second preferred of the present invention, undesired clicking is eliminated and deterioration of the operational feel is prevented, as in the first aspect of the present invention. Moreover, the non-clicking projection releases a much smaller amount of abrasion dust, which is deposited in the ends of its sliding track, thus reducing the disturbance of output caused by noise.

Other features, elements, characteristics, and advantages of the present invention will become more apparent from the following detailed description of preferred embodiments thereof with reference to the attached drawings.

BRIEF DESCRIPTION OF THE DRAWINGS

FIG. 12A illustrates a state in which the clicking projection is in its sliding state, and FIG. 12B illustrates a state in which the clicking projection is engaged with the clicking aperture;

DETAILED DESCRIPTION OF PREFERRED EMBODIMENTS

Figure 1:
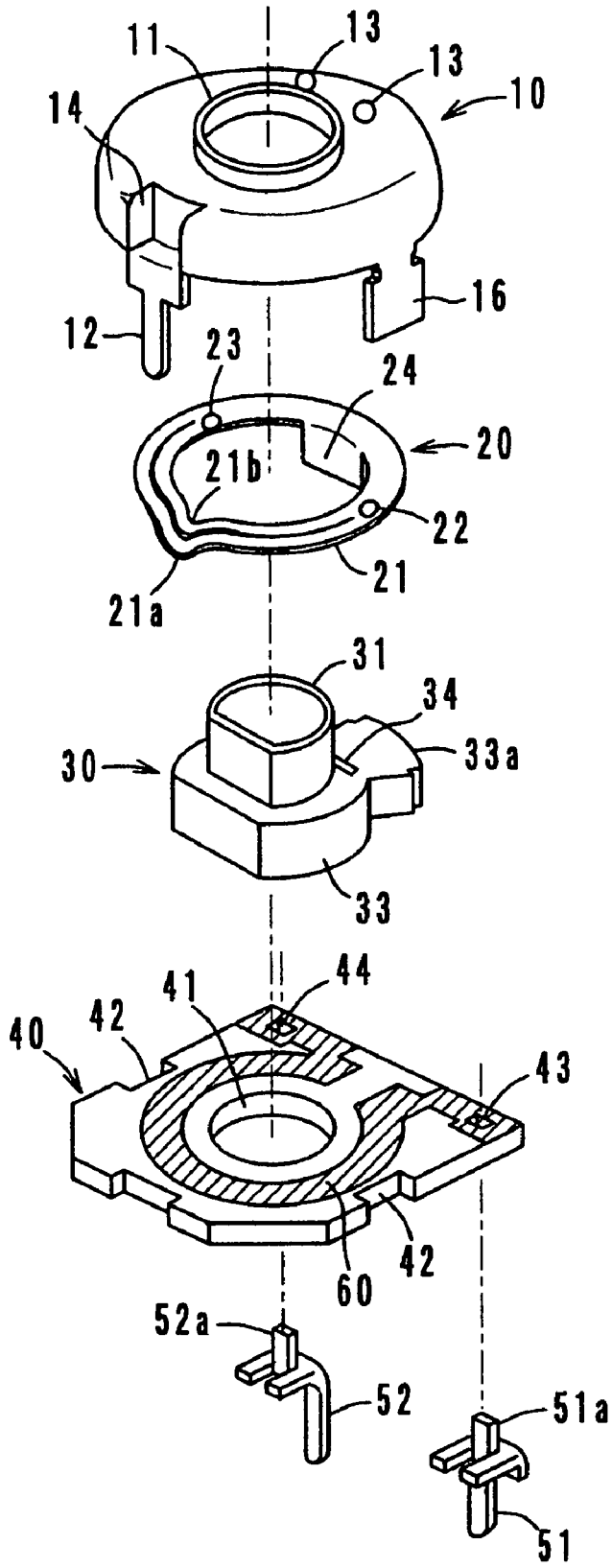
FIG. 1 is a perspective diagram of a rotatable variable resistor provided with a clicking mechanism in a disassembled state, according to a first preferred embodiment of the present invention.
Figure 2:
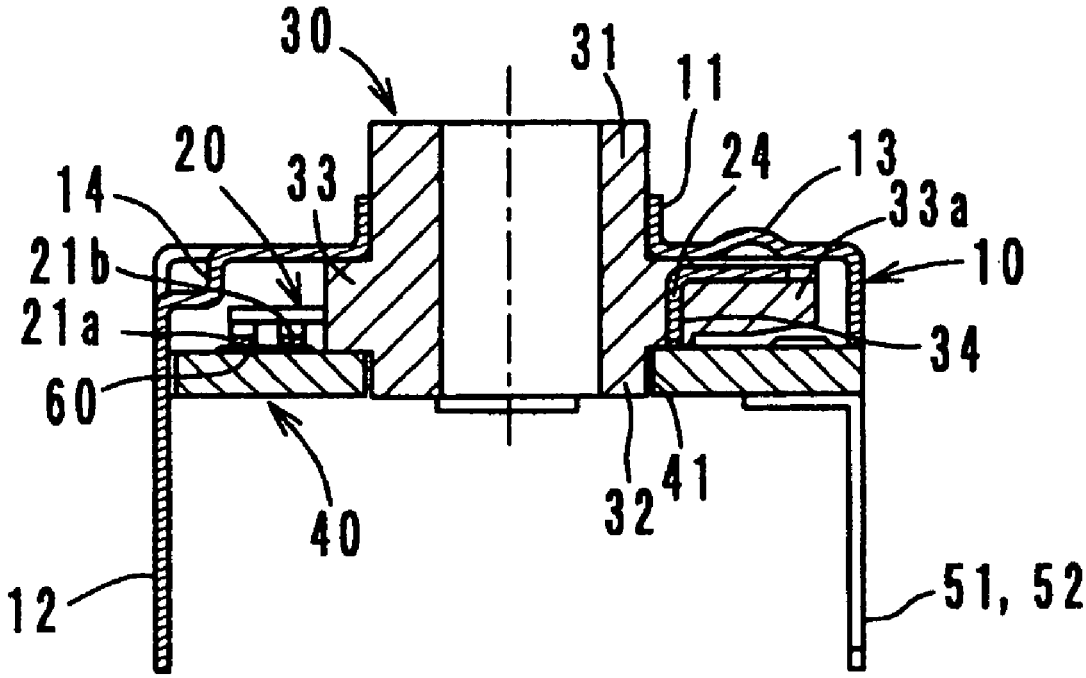
FIG. 2 is a cross-sectional view of the variable resistor of the first preferred embodiment of the present invention.

Preferred embodiments of a rotatable variable resistor provided with a clicking mechanism according to the present invention will now be described with reference to the attached drawings.

First Preferred Embodiment

A first preferred embodiment will be described with reference to FIGS. 1 to 6.

Referring to FIGS. 1 to 4, the rotatable variable resistor provided with a clicking mechanism according to the first preferred embodiment of the present invention preferably includes a cover 10, a wiper 20, a rotor 30, a resistor substrate 40, and external terminals 51 and 52. The wiper 20 and the rotor 30 define a rotary unit. The cover 10, the resistor substrate 40, and the external terminals 51 and 52 define a fixed unit.

The cover 10 is preferably formed of a conductive material and has an integrated structure which includes a substantially cylindrical portion 11 in the approximate central upper surface of the cover 10, an external terminal 12 extending downward along the side of the cover 10, and a pair of tabs 16 extending downward along the side of the cover 10. Moreover, the cover 10 is provided with a pair of semispherical clicking-depressions 13.

The wiper 20 is preferably formed of a conductive material and is provided with an arm segment 21 which has contact portions 21*a* and 21*b*. The arm segment 21 has a slit through the approximate center thereof extending in a range of substantially 180° to form two separated sub-segments, and is curved downwards.

Figure 5:
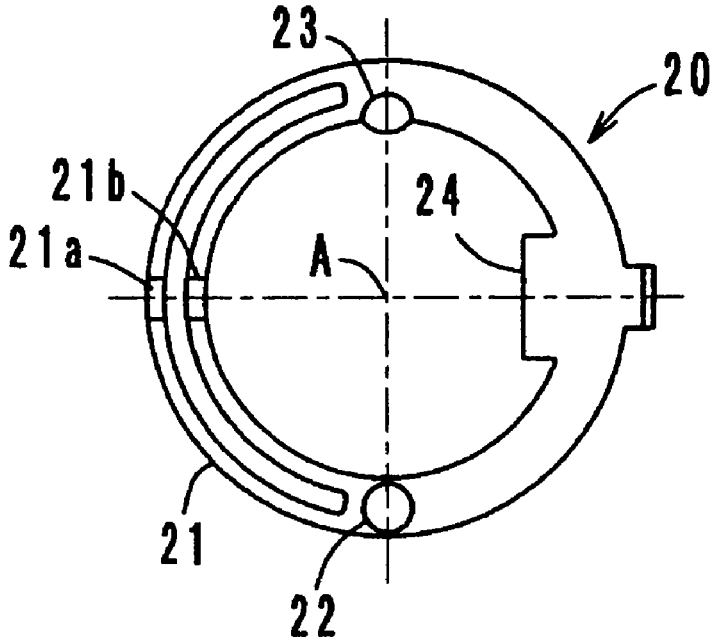
FIG. 5 is a plan view of a wiper according to the first preferred embodiment of the present invention.
Figure 6:
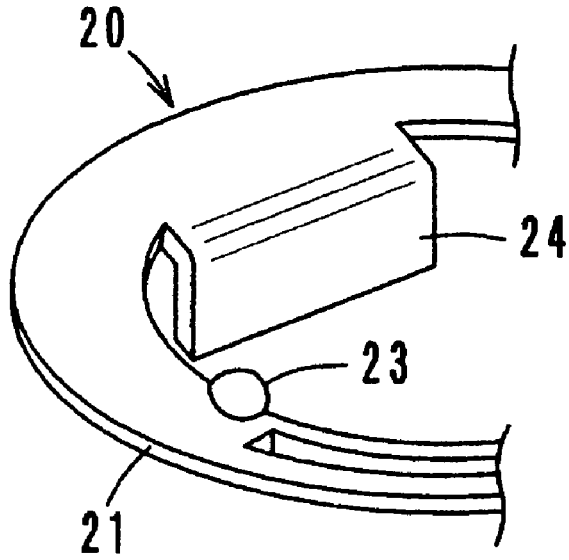
FIG. 6 is a perspective view of a section of the wiper according to the first preferred embodiment of the present invention.

The wiper 20 is further provided with a clicking projection 22 and a non-clicking projection 23 which are symmetrically disposed substantially 180° from each other on the arm segment 21. Referring to FIG. 5, the two projections 22 and 23 have a semispherical structure, and the distances from the center of rotation A to the top of the projections 22 and 23 are different. The distance from the top of the clicking projection 22 to the center of rotation A, namely, the radius according to which the projection 22 slides, is equivalent to the distance from the bottom of each clicking depression 13 to the center of rotation A.

Referring to FIGS. 1 to 4, the rotor 30 is preferably formed of an insulative material and has an integrated structure which includes an upper substantially cylindrical portion 31, a lower substantially cylindrical portion 32, and a flanged portion 33. One side of the flanged portion 33 has a protrusion 33*a* which extends outward in the horizontal direction.

The resistor substrate 40 is provided with a center hole 41 and an Ω-shaped or a sprit ring-shaped resistor layer 60 disposed on the upper surface, which is shown as the shaded section in FIG. 1. The two ends of the resistor layer 60 are electrically and mechanically connected to the upper ends of the external terminals 51 and 52, respectively. In detail, the external terminals 51 and 52 respectively have upper tabs 51*a* and 52*a* which are inserted through corresponding holes 43 and 44 provided in the resistor substrate 40 from the underside of the substrate 40. The tabs 51*a* and 52*a* are bent back on the resistor layer 60 and are then jointed together with the resistor layer 60 using, for example, conductive adhesive, or by, for example, soldering or welding.

The above-described components are assembled together as in the following process. First, the wiper 20 is combined with the rotor 30. Here, a protruding segment 24, which is provided in the wiper 20, is inserted into a slot 34 provided in the rotor 30 so as to integrate the wiper 20 with the rotor 30.

The lower substantially cylindrical portion 32 of the rotor 30 is then fitted into the center hole 41 of the resistor substrate 40, and the upper substantially cylindrical portion 31 is engaged with the substantially cylindrical portion 11 of the cover 10. Accordingly, the wiper 20-rotor 30 assembly is supported by the resistor substrate 40 and the cover 10 in a rotatable manner. The tabs 16 of the cover 10 are then engaged with notches 42, which are provided in the resistor substrate 40, and are bent back on the undersurface of the substrate 40 so as to integrate the cover 10 with the resistor substrate 40.

In the variable resistor assembled together by the above-described process, the contact portions 21*a* and 21*b* of the wiper 20 are resiliently urged against the resistor layer 60 in a slidable manner and are electrically connected with the layer 60. Furthermore, the clicking projection 22 and the non-clicking projection 23 are resiliently urged against the undersurface of the cover 10 in a slidable manner and are electrically connected with the cover 10. With respect to the angle of rotation of the rotor 30, the contact positions between the contact portions 21*a* and 21*b* and the resistor layer 60 are shifted, whereby the resistance value between the external terminal 12 and the external terminals 51 and 52 may be varied.

The rotational range of the rotor 30 is regulated by a stopper 14 provided in the cover 10 such that the protrusion 33*a* abuts against the inner walls of the stopper 14.

According to the first preferred embodiment, the clicking projection 22 of the wiper 20 slides on the cover 10 and engages with the clicking depressions 13, thus imparting a feel of a "click". Moreover, the non-clicking projection 23 of the wiper 20 slides on the cover 10 to keep the balance of the wiper 20 and the rotor 30, and eliminates unsteady contact between the wiper 20 and the cover 10 as the clicking projection 22 comes into and out of the clicking depressions 13.

Figure 9A:
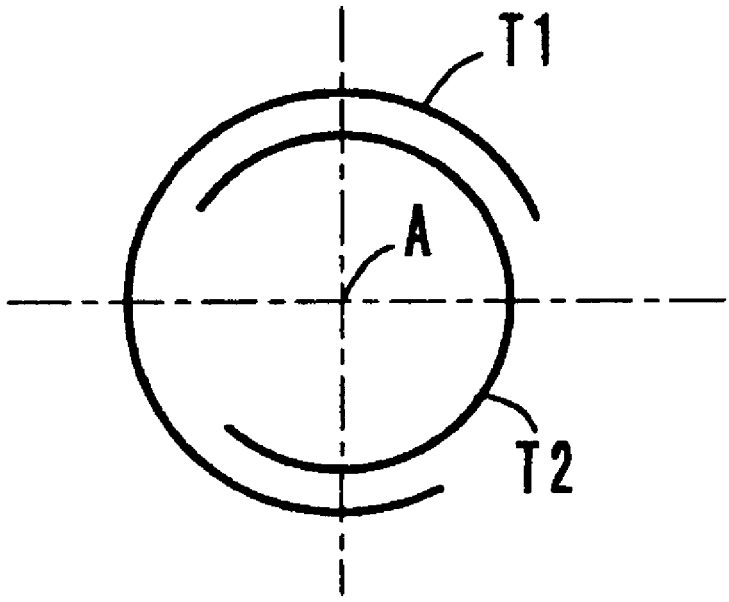
FIG. 9A illustrates a sliding track of a clicking projection and a sliding track of a non-clicking projection according to the first and second preferred embodiments.

Furthermore, because the clicking projection 22 and the non-clicking projection 23 slide with respect to different radii, the non-clicking projection 23 does not engage with the clicking depressions 13, thus eliminating undesired clicking of the projection 23. Accordingly, this achieves a desirable state where a smooth operational feel of the rotor 30 is maintained. Referring to FIG. 9A, the relationship between a sliding track T1 of the clicking projection 22 and a sliding track T2 of the non-clicking projection 23 are illustrated.

Because the clicking projection 22 and the non-clicking projection 23 do not slide over each other's abrasion dust deposited in the ends of the sliding tracks T1 and T2, the disturbance of output caused by noise is eliminated.

Furthermore, in the first preferred embodiment, since the cover 10 is provided with the external terminal 12, the cover 10 not only functions as a casing but also as a collector, that is, one of the external terminal. This reduces the number of required components to allow an easier assembly process.

Second Preferred Embodiment

A second preferred embodiment will now be described with reference to FIG. 7.

Figure 7:
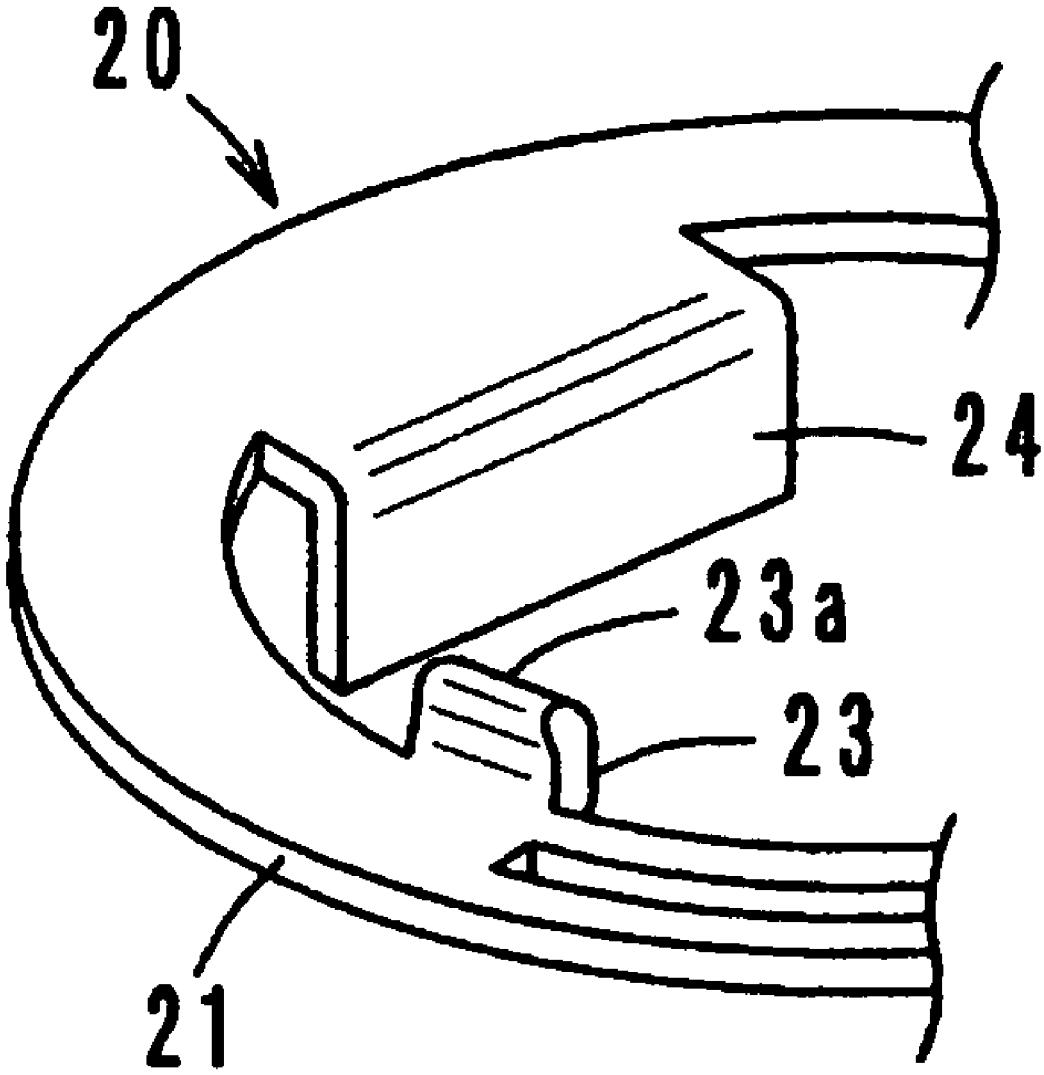
FIG. 7 is a perspective view of a section of a wiper according to a second preferred embodiment of the present invention.

FIG. 7 illustrates a relevant section, i.e. a section of the wiper 20, of the rotatable variable resistor provided with a clicking mechanism according to the second preferred embodiment of the present invention. The variable resistor of the second preferred embodiment basically includes the same components as those included in the variable resistor of the first preferred embodiment. The difference is that the non-clicking projection 23 of the wiper 20 in the second preferred embodiment alternatively has a top portion 23*a* which extends linearly in the rotational direction of the wiper 20.

In detail, a protruding tab is provided at one side of the arm segment 21, and the tab is bent upward so as to form the non-clicking projection 23. Since the top portion 23*a* is longer in the sliding direction, the abrasion resistance of the top portion 23*a* is improved. This contributes to a longer life cycle of the wiper 20. Other advantages of the second preferred embodiment are similar to those of the first preferred embodiment.

Third Preferred Embodiment

A third preferred embodiment will now be described with reference to FIG. 8.

Figure 8:
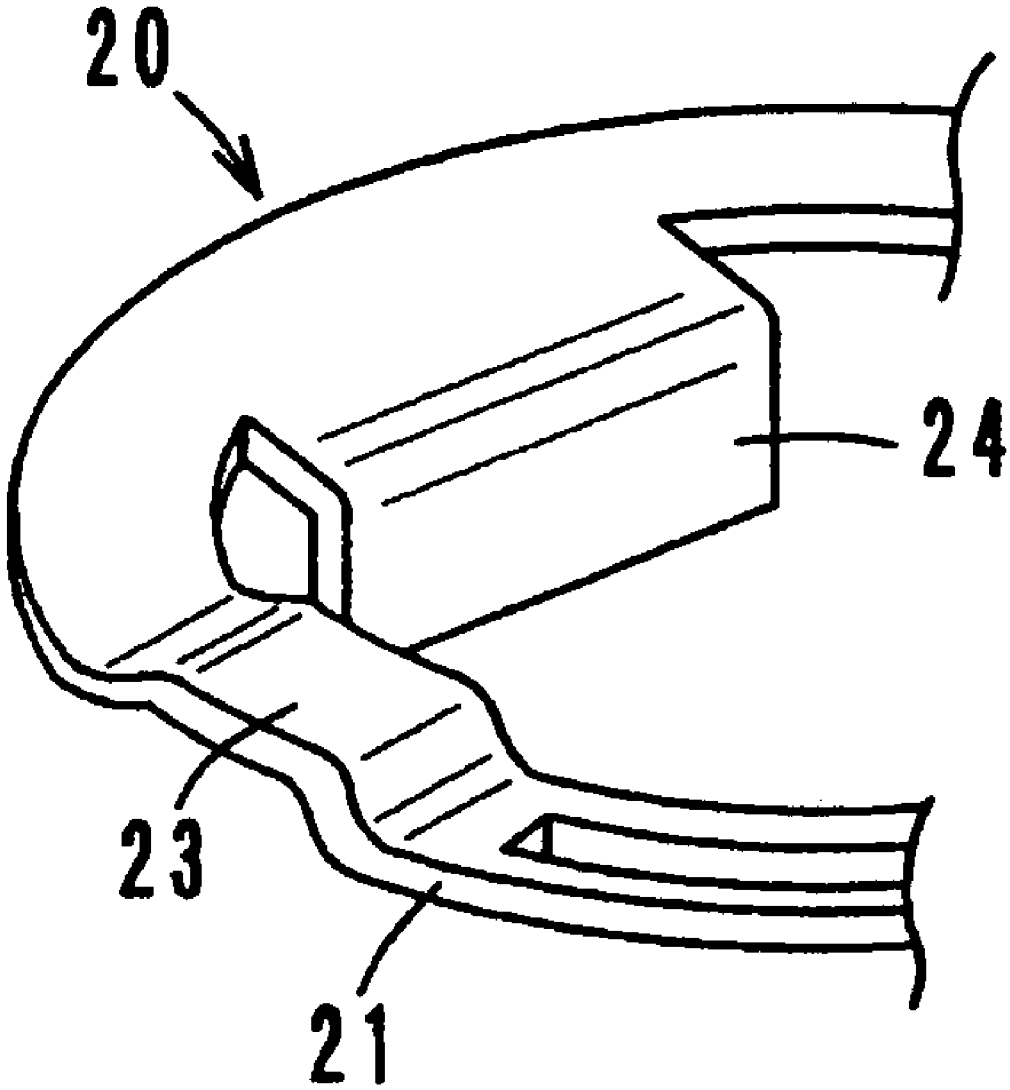
FIG. 8 is a perspective view of a section of a wiper according to a third preferred embodiment of the present invention.

FIG. 8 illustrates a relevant section, i.e. a section of the wiper 20, of the rotatable variable resistor provided with a clicking mechanism according to the third preferred embodiment of the present invention. The variable resistor of the third preferred embodiment basically includes the same components as those included in the variable resistor of the first preferred embodiment.

Figure 9B:
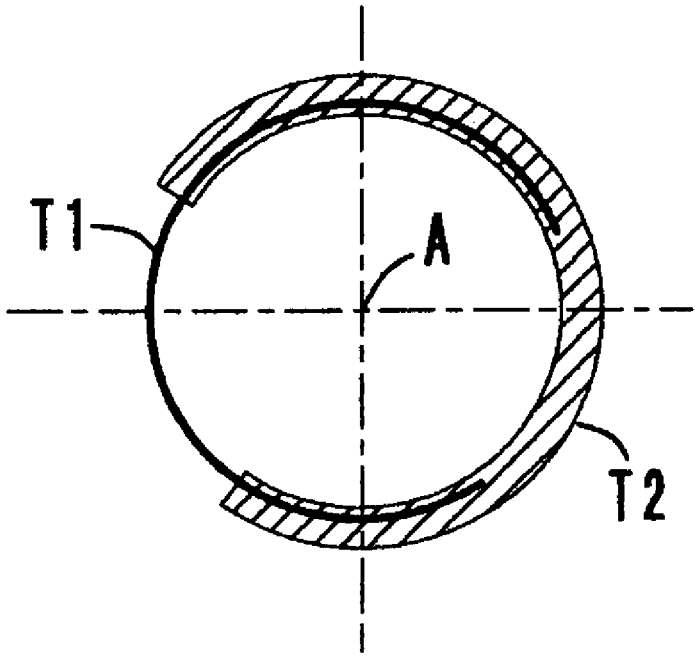
FIG. 9B illustrates a sliding track of a clicking projection and a sliding track of a non-clicking projection according to the third preferred embodiment of the present invention.

The difference is that the non-clicking projection 23 in the third preferred embodiment has a flat top portion whose width in a direction is greater than that of each clicking depression 13, and the surface of the flat top portion contacts the undersurface of the cover 10. Referring to FIG. 9B, the sliding track T1 of the top of the clicking projection 22 is located within the sliding track T2 of the non-clicking projection 23 in the radius direction.

In detail, the non-clicking projection 23 is formed by bending a section of the arm segment 21 across the width of the segment 21. In the third preferred embodiment, since the width of the flat top portion is greater than that of each depression 13, the projection 23 does not engage with the depressions 13, thus eliminating undesired clicking of the projection 23. Accordingly, this prevents deterioration of the operational feel. Furthermore, the larger surface of the flat top portion contacting the cover 10 improves the abrasion resistance, thus contributing to a longer life cycle of the wiper 20.

According to this structure, although the sliding tracks T1 and T2 of the clicking projection 22 and the non-clicking projection 23 overlap with each other, because the non-clicking projection 23 has a larger engaging surface, the non-clicking projection 23 releases a much smaller amount of abrasion dust, which is deposited in the ends of the sliding track T2, thus reducing the disturbance of output caused by noise. Other advantages of the third preferred embodiment are similar to those of the first preferred embodiment.

Figure 10:
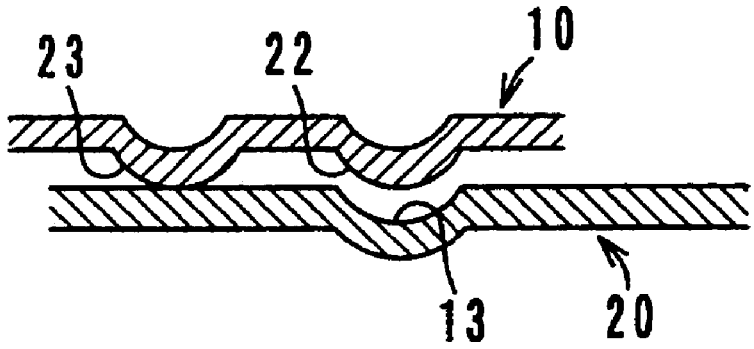
FIG. 10 is a cross-sectional view illustrating the relationship among the clicking projection, the non-clicking projection, and one of clicking depressions.

Referring to FIG. 10, the structures of the clicking projection 22, the non-clicking projection 23, and one of the clicking depressions 13 are illustrated.

According to the first, second, and third preferred embodiments, the clicking projection 22 and the non-clicking projection 23 are provided in the wiper 20 and the clicking depressions 13 are provided in the cover 10. Alternatively, in the present invention, the projections 22 and 23 may be provided in the cover 10 and the depressions 13 may be provided in the wiper 20. However, it is more preferable to provide the projections 22 and 23 in the wiper 20, and the depressions 13 in the cover 10, as in the first, second, and third preferred embodiments.

The following description explains why it is not necessarily preferable to provide the projections 22 and 23 in the cover 10 and the depressions 13 in the wiper 20. Unlike the sliding surface of the cover 10, the wiper 20 does not have an even surface around the circumference because the wiper 20 has the arm segment 21. For this reason, in a case where the projections 22 and 23 are provided in the cover 10, when one of the projections 22 and 23 faces the arm segment 21, the contact pressure applied against the wiper 20 is lowered, or the projection 22 or 23 will not come in contact with the wiper 20. This may possibly cause the rotor 30 and the wiper 20 to lose balance and tilt. Furthermore, the changing of the contact pressure of the projections 22 and 23 against the wiper 20 in the middle of a rotational process may fluctuate the rotary torque of the wiper 20, i.e. the rotor 30, thus deteriorating the operational feel.

As shown in FIG. 10, if the projections 22 and 23 are disposed at a small interval of, for example, 30°, the non-clicking projection 23 might interfere with the engagement between the clicking projection 22 and the clicking depression 13, thus causing a problem.

Fourth Preferred Embodiment

A fourth preferred embodiment will now be described with reference to FIGS. 11 and 12.

Figure 11:
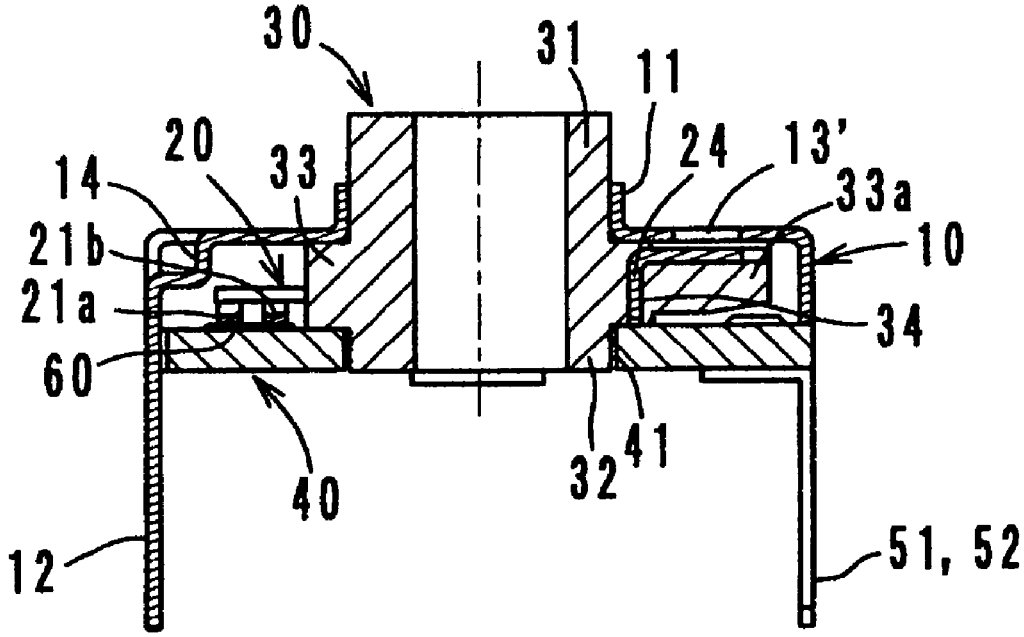
FIG. 11 is a cross-sectional view of a rotatable variable resistor provided with a clicking mechanism, according to a fourth preferred embodiment of the present invention.

FIG. 11 illustrates the rotatable variable resistor provided with a clicking mechanism according to the fourth preferred embodiment of the present invention. The variable resistor of the fourth preferred embodiment basically includes the same components as those included in the variable resistor of the first preferred embodiment. The difference is that clicking apertures 13' are provided in the cover 10 in place of the clicking depressions 13.

Figure 12A:
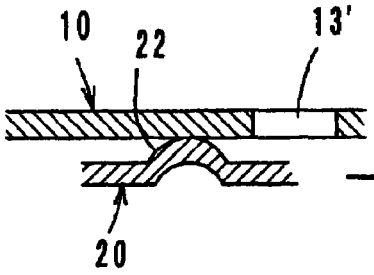
FIGS. 12A and 12B are cross-sectional views illustrating the relationship between a clicking projection and one of clicking apertures according to the fourth preferred embodiment.
Figure 12B:
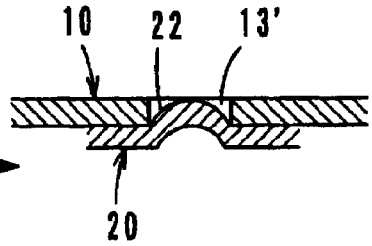
Figure 13:
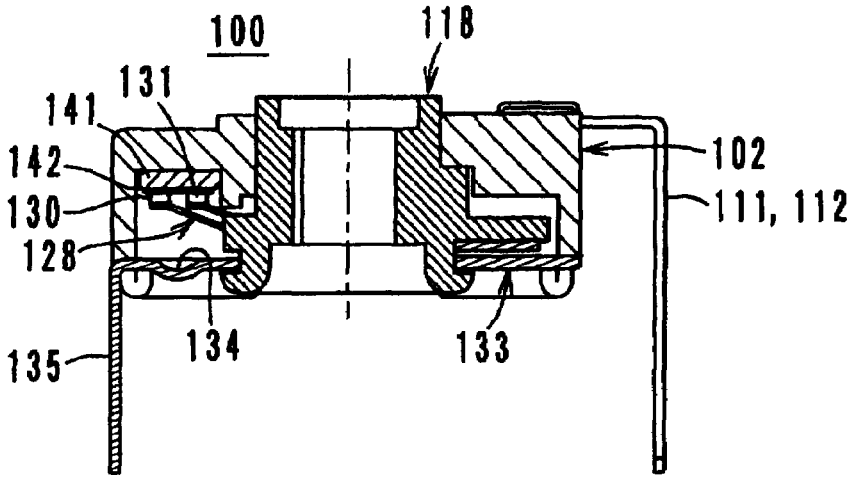
FIG. 13 PRIOR ART
FIG. 13 is a cross-sectional view of an example of a conventional rotatable variable resistor provided with a clicking mechanism.
Figure 14:
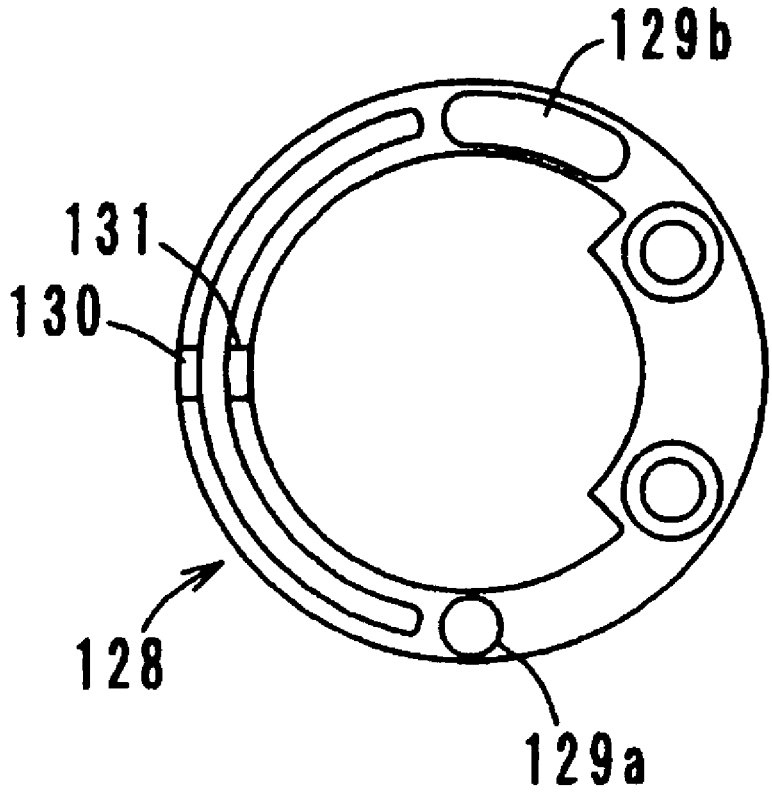
FIG. 14 PRIOR ART
FIG. 14 is a plan view of a wiper included in the variable resistor shown in FIG. 13.

FIG. 12A illustrates a state in which the clicking projection 22 is sliding on the undersurface of the cover 10. FIG. 12B illustrates a state in which the clicking projection 22 is engaged with one of the clicking apertures 13' of the cover 10.

By providing the apertures 13' for the clicking engagement portions, as in the fourth preferred embodiment, a better feel of a "click" is imparted to an operator as the clicking projection 22 engages with the apertures 13'. Moreover, a good "click" is achieved even with a low contact pressure, thus leading to size reduction of the wiper 20. Accordingly, this contributes to a size reduction of the entire variable resistor.

Other Embodiments

The rotatable variable resistor provided with a clicking mechanism according to the present invention is not limited to the above-described preferred embodiments, and modifications are permissible within the scope and spirit of the present invention.

Figure 3:
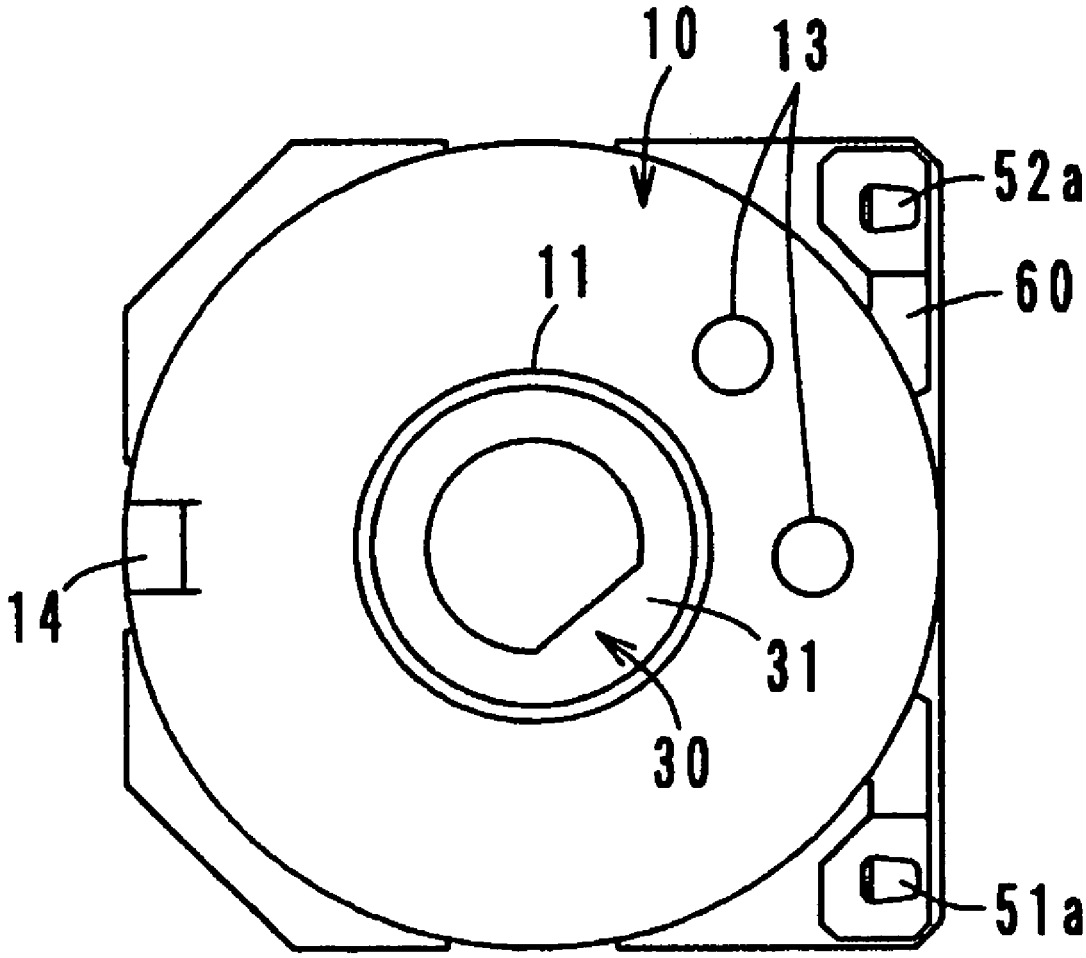
FIG. 3 is a plan view of the variable resistor of the first preferred embodiment of the present invention.
Figure 4:
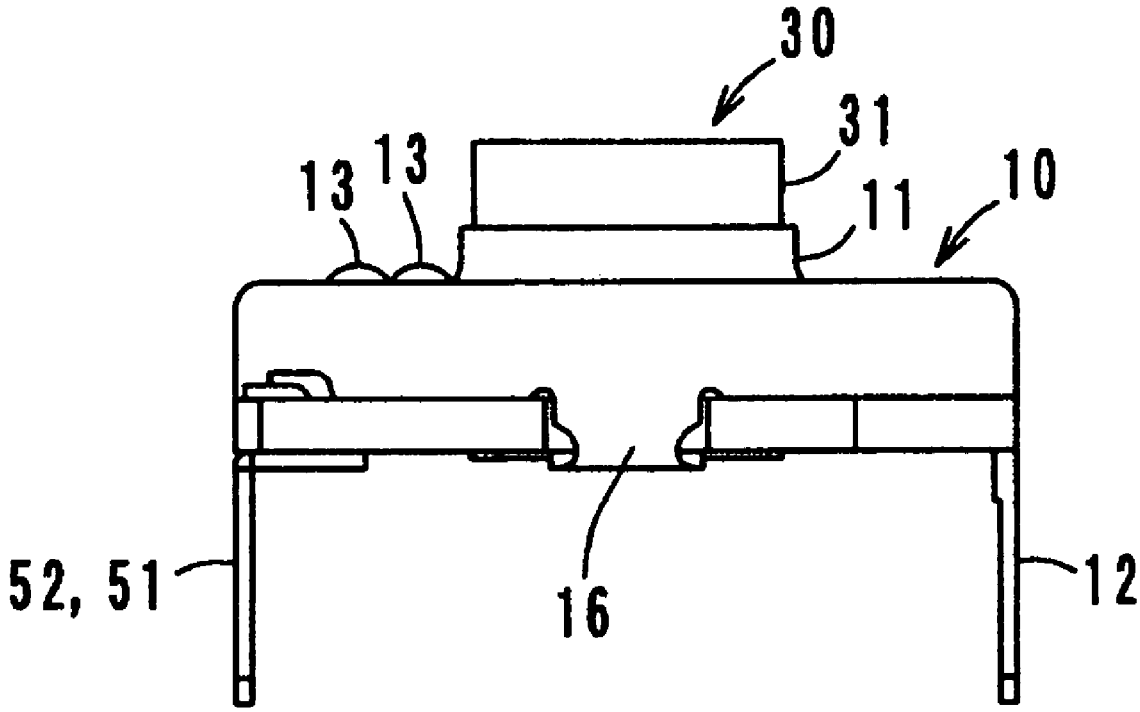
FIG. 4 is a front view of the variable resistor of the first preferred embodiment of the present invention.

For example, referring to FIG. 3, the inner surface of the upper substantially cylindrical portion 31 of the rotor 30 may be D-shaped in plan view so as to allow the rotor 30 to be rotated using, for example, a shaft, which is not shown in the drawings. Alternatively, the inner surface of the upper substantially cylindrical portion 31 in plan view and the cross section of the shaft may have any type of shape, such as a rectangular shape, that allows engagement between the two. Furthermore, the shaft may alternatively be integrated or unitary with the rotor 30 such that the shaft extends outward from the central portion of the rotor 30.

Moreover, for further abrasion resistance and noise reduction of the sliding surfaces of the components, grease may be applied to the surfaces. The sliding surfaces in this case refer to sliding contact surfaces between the wiper 20 and the resistor layer 60, the wiper 20 and the cover 10, the rotor 30 and the resistor substrate 40, and the rotor 30 and the cover 10.

Furthermore, the protruding segment 24 of the wiper 20 may be provided with a notch so as to prevent the segment 24 from coming off the slot 34 of the rotor 30. Alternatively, the external terminal 12 and the external terminals 51 and 52 may be provided with beads for preventing deformation.

While preferred embodiments of the invention have been described above, it is to be understood that variations and modifications will be apparent to those skilled in the art without departing the scope and spirit of the invention. The scope of the invention, therefore, is to be determined solely by the following claims.

What is claimed is:

1. A rotatable variable resistor comprising:

a rotary unit including a rotor and a wiper; and a fixed unit including a resistor substrate and an external terminal; wherein one of the rotary unit and the fixed unit is provided with a clicking projection and a non-clicking projection;

the other one of the rotary unit and the fixed unit is provided with a clicking engagement portion which is engageable with the clicking projection;

a distance from a center of rotation of the rotary unit to a top of the clicking projection is different from a distance from the center of rotation of the rotary unit to a top of the non-clicking projection;

the fixed unit further includes a conductive cover integrated with the external terminal; and the clicking projection and the non-clicking projection are provided in the wiper and the clicking engagement portion is provided in the cover.

2. The rotatable variable resistor according to claim 1, wherein the non-clicking projection has a top portion extending linearly in the rotational direction of the rotary unit.

3. A rotatable variable resistor comprising:

a rotary unit including a rotor and a wiper; and a fixed unit including a resistor substrate and an external terminal; wherein one of the rotary unit and the fixed unit is provided with a clicking projection and a non-clicking projection;

the other one of the rotary unit and the fixed unit is provided with a clicking engagement portion which is engageable with the clicking projection;

the non-clicking projection has a flat top portion, a width in one direction of the flat top portion is greater than that of the clicking engagement portion, a surface of the flat top portion is in contact with the other one of the fixed unit and the rotary unit;

a sliding track of the top of the clicking projection is located within a sliding track of the non-clicking projection in a radius direction thereof;

the fixed unit further includes a conductive cover integrated with an external terminal; and the clicking projection and the non-clicking projection are provided in the wiper and the clicking engagement portion is provided in the cover.

4. The rotatable variable resistor according to claim 1, wherein two of the external terminals are provided and the resistor substrate, the cover and the two external terminals define the fixed unit.

5. The rotatable variable resistor according to claim 1, wherein the cover includes a pair of clicking engagement portions defined by depressions.

6. The rotatable variable resistor according to claim 1, wherein the clicking engagement portion is an aperture.

7. The rotatable variable resistor according to claim 1, wherein the clicking engagement portion is a depression.

8. The rotatable variable resistor according to claim 1, wherein the clicking projection and the non-clicking projection are symmetrically disposed substantially 180° from each other.

9. The rotatable variable resistor according to claim 1, wherein the wiper includes contact portions which are resiliently urged against the resistor layer in a slidable manner and are electrically connected with the resistor layer.

10. The rotatable variable resistor according to claim 1, wherein the clicking projection and the non-clicking projection are resiliently urged against an undersurface of the cover in a slidable manner and are electrically connected with the cover.

11. The rotatable variable resistor according to claim 1, wherein the clicking projection and the non-clicking projection are arranged to slide with respect to different radii.

12. A rotatable variable resistor comprising:

a rotary unit including a rotor and a wiper; and a fixed unit including a resistor substrate and an external terminal; wherein one of the rotary unit and the fixed unit is provided with a clicking projection and a non-clicking projection;

the other one of the rotary unit and the fixed unit is provided with a clicking engagement portion which is engageable with the clicking projection;

a distance from a center of rotation of the rotary unit to a top of the clicking projection is different from a distance from the center of rotation of the rotary unit to a top of the non-clicking projection;

the fixed unit further includes a conductive cover integrated with the external terminal; and the clicking projection and the non-clicking projection are provided in the cover and the clicking engagement portion is provided in the wiper.

13. The rotatable variable resistor according to claim 3, wherein the clicking engagement portion is an aperture.

14. The rotatable variable resistor according to claim 3, wherein the clicking engagement portion is a depression.

15. The rotatable variable resistor according to claim 3, wherein the surface of the flat top portion contacts an undersurface of the cover.

16. A rotatable variable resistor comprising:

a rotary unit including a rotor and a wiper; and a fixed unit including a resistor substrate and an external terminal; wherein one of the rotary unit and the fixed unit is provided with a clicking projection and a non-clicking projection;

the other one of the rotary unit and the fixed unit is provided with a clicking engagement portion which is engageable with the clicking projection;

the non-clicking projection has a flat top portion, a width in one direction of the flat top portion is greater than that of the clicking engagement portion, a surface of the flat top portion is in contact with the other one of the fixed unit and the rotary unit;

a sliding track of the top of the clicking projection is located within a sliding track of the non-clicking projection in a radius direction thereof;

the fixed unit further includes a conductive cover integrated with an external terminal; and the clicking projection and the non-clicking projection are provided in the cover and the clicking engagement portion is provided in the wiper.

17. The rotatable variable resistor according to claim 12, wherein the non-clicking projection has a top portion extending linearly in the rotational direction of the rotary unit.

18. The rotatable variable resistor according to claim 12, wherein two of the external terminals are provided and the resistor substrate, the cover and the two external terminals define the fixed unit.

19. The rotatable variable resistor according to claim 12, wherein the cover includes a pair of clicking engagement portions defined by depressions.

20. The rotatable variable resistor according to claim 12, wherein the clicking engagement portion is an aperture.

21. The rotatable variable resistor according to claim 12, wherein the clicking engagement portion is a depression.

22. The rotatable variable resistor according to claim 12, wherein the clicking projection and the non-clicking projection are symmetrically disposed substantially 180° from each other.

23. The rotatable variable resistor according to claim 12, wherein the wiper includes contact portions which are resiliently urged against the resistor layer in a slidable manner and are electrically connected with the resistor layer.

24. The rotatable variable resistor according to claim 12, wherein the clicking projection and the non-clicking projection are arranged to slide with respect to different radii.

25. The rotatable variable resistor according to claim 16, wherein the clicking engagement portion is an aperture.

26. The rotatable variable resistor according to claim 16, wherein the clicking engagement portion is a depression.

27. The rotatable variable resistor according to claim 16, wherein the surface of the fiat top portion contacts an undersurface of the cover.

* * * * *